US005294587A

United States Patent [19]

Nakagami et al.

[11] Patent Number: 5,294,587

[45] Date of Patent: Mar. 15, 1994

[54] THERMAL RECORDING MEDIUM

[75] Inventors: Shigeru Nakagami; Haruhiko Ohsawa; Yutaka Takagi; Tadahide Sugimoto; Minoru Fujita; Yoshihiko Nakahara, all of Tokyo, Japan

[73] Assignee: Kyodo Printing Co., Ltd., Tokyo, Japan

[21] Appl. No.: 573,126

[22] PCT Filed: Jan. 18, 1990

[86] PCT No.: PCT/JP90/00047

§ 371 Date: Sep. 17, 1990

§ 102(e) Date: Sep. 17, 1990

[87] PCT Pub. No.: WO90/08042

PCT Pub. Date: Jul. 26, 1990

[30] Foreign Application Priority Data

Jan. 20, 1989 [JP] Japan ..... 1-9944

[51] Int. Cl.[5] ..... B41M 5/30; B41M 5/40

[52] U.S. Cl. ..... 503/204; 503/200; 503/226; 427/152

[58] Field of Search ..... 503/200, 226; 428/195, 428/913; 427/152

[56] References Cited

U.S. PATENT DOCUMENTS 4,727,054 2/1988 Yuyama ..... 503/200

4,727,055 2/1988 Aoyagi et al. ..... 503/200

FOREIGN PATENT DOCUMENTS 2515165 10/1975 Fed. Rep. of Germany .

5251943 10/1975 Japan .

54118847 3/1978 Japan .

59-57787 4/1984 Japan .

61-29586 2/1986 Japan .

1402760 8/1975 United Kingdom .

1507728 4/1978 United Kingdom .

OTHER PUBLICATIONS

International Search Report.

*Primary Examiner*—Patrick J. Ryan

*Assistant Examiner*—William A. Krynski

*Attorney, Agent, or Firm*—Baker & Daniels

[57] ABSTRACT

A thermal recording medium good in recording sensitivity and recording stability comprising a metal thin layer, a heat sensitive softening layer placed in contact with said metal thin layer, a contrasting layer placed in contact with said heat sensitive softening layer or said metal thin layer and having a visual contrast to said metal thin layer, and a heat sensitive color forming layer placed in contact with said heat sensitive softening layer or said metal thin layer on the side of said metal thin layer opposite to the side where the contrasting layer is positioned.

23 Claims, 1 Drawing Sheet

THERMAL RECORDING MEDIUM

BACKGROUND OF THE INVENTION

This invention relates to a thermal recording medium, and more particularly, to a thermal recording medium good in recording sensitivity and recording stability.

The present invention can be effectively applied to recording wherein figures and the like are printed to correspond to magnetically recorded contents in a prepaid magnetic card such as a telephone card so that the magnetically recorded contents may be visually recognized.

Conventionally, there are two methods for recording information on a recording paper by heating the heating element of a thermal head at desired timing according to recording signals while scanning said thermal head over the recording paper. These methods are: a heat transcription method in which a desired pattern is transcribed on a normal recording paper by heating and melting the ink of a heat sensitive ink ribbon which is interposed between a thermal head and the recording paper; and a thermal method in which a thermal recording paper is colored in a desired pattern.

The thermal method is advantageous in that since ink is not applied to a recording paper, and the heat sensitive layer of the recording paper itself is colored, the printed record is hardly affected adversely even when external frictional force is applied to the recording paper after recording, and in addition no ink ribbons are necessary.

However, in the conventional thermal method, since recording is effected based on chemical changes in a heat sensitive color forming layer, and the chemical changes are reversible, the record may change under some circumstantial conditions after the recording, and therefore the thermal method is accompanied by a problem that the record is not stable.

In order to solve such a problem, a new heat sensitive recording method is suggested wherein, instead of a recording paper having a heat sensitive color forming layer as mentioned above, a recording medium having a metal thin layer, a heat sensitive softening layer positioned in contact with the metal thin layer, and a contrasting layer is used, while the recording medium is scanned by a thermal head and heating elements are heated at suitable timing so that desired positions of the metal thin layer may be heated and melted to allow the metal thin layer to be dispersed at said desired positions as fine particles into the heat sensitive softening layer which has been softened thereby causing the metal thin layer and the contrasting layer to be contrasted visually at said desired positions and the remaining positions for recording.

However, in this method since it is required to melt the metal thin layer, a large amount of heat is needed for sufficiently favorable recording, that is, this method is defective in that the recording sensitivity is not sufficient.

SUMMARY OF THE INVENTION

Therefore, in view of the above problems of the prior art, the object of the present invention is to provide a thermal recording medium good in recording sensitivity and recording stability.

According to the present invention, the above object can be attained by providing a heat sensitive recording medium, comprising a metal thin layer, a heat sensitive softening layer placed in contact with said metal thin layer, a contrasting layer which is placed in contact with the said heat sensitive softening layer or said metal thin layer and has a visual contrast to said metal thin layer, and a heat sensitive color forming layer placed in contact with said heat sensitive softening layer or said metal thin layer on the side of said metal thin layer opposite to the side where said contrasting layer is positioned.

In the present invention, the contrasting layer can be placed on a base with it in contact with the base, and can also act as a magnetic recording layer, a protective layer can be placed on the surface on the side of the metal thin layer opposite to the side where the contrasting layer is positioned, the contrasting layer can also act as one of heat sensitive softening layers, and the heat sensitive color forming layer can comprises a leuco dye, an acid developer, and a binder resin.

According to the present thermal recording medium as described above, by partially coloring the heat sensitive color forming layer in a desired recording pattern, and physically destroying the metal thin layer, visible information can be recorded as a contrast between a mixed tint of the metal thin layer and the uncolored heat sensitive color forming layer and a mixed tint of the contrasting layer and the colored heat sensitive color forming layer, so that both the recording sensitivity and the recording stability can be made favorable.

DETAILED DESCRIPTION OF THE INVENTION

Specified examples of the present invention will now be described with reference to the drawings.

Figure 1:
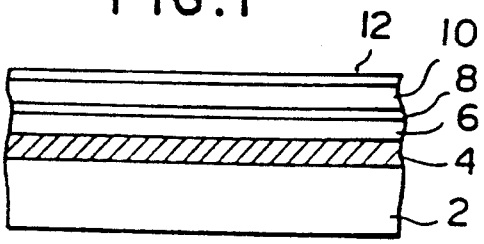
FIGS. 1 to 4 are schematic partial cross sectional views, showing the present thermal recording mediums.

FIG. 1 is a schematic partial cross sectional view of a first example of the present thermal recording medium.

In FIG. 1, a contrasting layer 4 is formed on the surface (upper surface) of a base 2 , a heat sensitive softening layer 6 is formed on the contrasting layer, a metal thin layer 8 is formed on the heat sensitive softening layer, a heat sensitive color forming layer 10 is formed on the metal thin layer, and a protective layer 12 is formed on the heat sensitive color forming layer.

As the base 2, for example a synthetic resin sheet of polyethylene terephthalates, epoxy resins, polyvinyl chlorides, polycarbonates, or the like or a synthetic paper can be used. The base 2 can take a suitable shape such as a card-like shape.

The contrasting layer 4 may be one that has a visual contrast to the metal thin layer 8, and preferably the contrasting layer 4 has a black color or other deep color since generally the metal thin layer 8 is of a whitish color. As the contrasting layer 4, one can be used which is obtained by mixing a pigment or a dye having a desired color with a binder resin such as a polyester resin, an alkyd resin, a vinyl resin, or a polyurethane resin or a mixture of these resins. The thickness of the contrasting layer 4 is for example 20 $\mu$m or below, and preferably in the order of 1 to 15 $\mu$m.

The heat sensitive softening layer 6 is provided to improve the writing and recording characteristics of the meal thin layer 8 (sensitization effect), and is softened at the time of writing thereby dispersing and receiving fine particles resulting from the melted material of the metal thin layer. As a heat sensitive material for the heat sensitive layer 6, a material can be used which is composed of as a major component a low-melting natural resin such as shellac, a rosin, or a terpene resin, a synthetic resin such as a nitrocellulose resin, an acrylic resin, a polyester resin, a polyvinyl chloride resin, a polyvinylidene chloride resin, a vinyl acetate resin, a polystyrene resin, a polybutyral resin, or a polyolefin resin, or a combination of these, and if required as a viscosity lowering additive, a wax such as a paraffin wax, a microcrystalline wax, a synthetic oxidized wax, montan wax, Fischer-Tropsch wax, a low-molecular weight polyethylene wax, a paraffin wax derivative, a montan wax derivative, or a microcrystalline wax derivative, stearic acid, a stearate or the like. If the viscosity lowering additive is in the form of finely divided particles, the viscosity lowering additive is used by dispersing it in the major component while if it is solid, it is used by melting it by heating or by dissolving in a solvent to be mixed or compatibilized with the major component. The thickness of the heat sensitive softening layer 6 is for example 10 μm or below, and preferably in the order of 0.5 to 5 μm. It is required that the heat sensitive softening layer 6 is provided with heat resistance so that the heat sensitive softening layer 6 may resist heating when the metal thin layer 8 is formed thereon (for example by vacuum deposition).

The metal thin layer 8 conceals the contrasting layer 4, and is used as a writing and recording film, and as the metal material for the metal thin layer 8, a low-melting metal such as Sn, Bi, Se, Te, Zn, Pb, In, Cd, and Tl, or a low-melting alloy containing these metals such as Pb-Sn and Bi-Sn can be used. The thickness of the metal thin layer 8 is for example in the order of 100 to 2,000 Å, and preferably 300 to 1,500 Å.

As the heat sensitive color forming layer 10, one containing a leuco dye, an acid developer and a binder resin can be used.

As the leuco dye in the heat sensitive color forming layer 10, a triphenyl methane type leuco dye such as Crystal Violet Lactone and Malachite Green Lactone, a Fluoran type leuco dye such as 1,2-dibenzo-6-diethylaminofluoran, an Auramine type leuco dye such as N-benzoyl Auramine, a phenothiazine type leuco dye, and a spiropyran type leuco dye can be used.

As the acid developer in the heat sensitive color forming layer 10, a compound having a phenolic hydroxyl group, i.e., a phenolic compound can be used such as phenol, o-cresol, p-cresol, p-ethylphenol, t-butylphenol, 2,6-di-t-butyl-4-methylphenol, nonylphenol, dodecylphenol, styrenated phenol, 2,2'-methylenebis(4-methyl-6-t-butylphenol), α-naphthol, β-naphthol, hydroquinonemonomethyl ether, guaiacol, eugenol, p-chlorophenol, p-bromophenol, o-chlorophenol, p-phenylphenol, o-bromophenol, 2,6-trichlorophenol, o-phenylphenol, p-(p-chlorophenyl)phenol, o-(o-chlorophenyl)phenol, salicylic acid, ethyl p-oxybenzoate, propyl p-oxybenzoate, octyl p-oxybenzoate, dodecyl p-oxybenzoate, catechol, hydroquinone, resorcinol, 3-methylcatechol, 3-isopropylcatechol, p-t-butylcatechol, 2,5-di-t-butylhydroquinone, 4,4'-methylenediphenol, bisphenol A, 1,2-dioxynaphthalene, 2,3-dioxynaphthalene, chlorocatechol, bromocatechol, 2,4-dihydroxybenzophenone, phenolphthalein, o-cresolphthalein, methyl protocatechuate, ethyl protocatechuate, propyl protocatechuate, octyl protocatechuate, dodecyl protocatechuate, pyrogallol, oxyhydroquinone, phloroglucinol, 2,4,6-trioxymethylbenzene, 2,3,4-trioxyethylbenzene, methyl gallate, ethyl gallate, propyl gallate, butyl gallate, hexyl gallate, octyl gallate, dodecyl gallate, cetyl gallate, stearyl gallate, 2,3,5-trioxynaphthalene, tannic acid, and phenolic resins.

As the binder resin in the heat sensitive color forming layer 10, use can be made of an alkyd resin, a vinyl chloride resin, a urethane resin, a xylene resin, a phenolic resin, a cumarone resin, a vinyltoluene resin, a terpene resin, a vinyltoluene/butadiene copolymer resin, a vinyltoluene/acrylate copolymer resin, a polyvinyl alcohol resin, a methyl cellulose resin, a hydroxyethyl cellulose resin, a carboxymethylcellulose resin, a methyl vinyl ether/maleic anhydride copolymer resin, a polyacrylic acid resin, gelatin, or gum arabic.

In the heat sensitive color forming layer, the ratio of the leuco dye to the acid developer is for example 1:0.5 to 1:3 (by equivalent), and the ratio of the binder resin to (the leuco dye+the acid developer) is for example 1:0.1 to 1:3 (by weight).

The thickness of the heat sensitive color forming layer 10 is for example 15 μm or below, and preferably in the order of 2 to 10 μm.

For the protective layer 12, for example a cellulose resin, a urethane resin, a polyester resin, a vinyl resin, an alkyd resin, an epoxy resin, or an acrylic resin that has heat resistance and abrasion resistance can be used. To these resins, a phthalic acid ester, an ester of fatty acid, phosphoric ester, or the like may be added as a plasticizer, and a low-molecular polyethylene, oleylamide, stearylamide, a silicone, or the like may be added for providing lubricity. Further, an ultraviolet-curing resin or an electron radiation curing resin of an acrylic resin type, an epoxy resin type, a polyester type or the like can be used. The thickness of the protective layer 12 is for example 10 μm or below, and preferably in the order of 1 to 5 μm.

Figure 2:
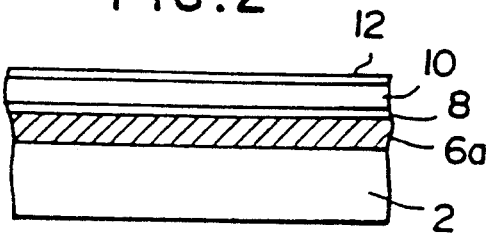

FIG. 2 is a schematic partial cross sectional view showing a second example of the present thermal recording medium, wherein parts identical with those in FIG. 1 are designated by the same reference characters.

In the example shown in FIG. 2, the reference character 6a indicates a heat sensitive softening layer that can also act as a contrasting layer. As the heat sensitive softening layer 6a, one can be used which is obtained by mixing a pigment or a dye having a desired color into the heat sensitive softening layer 6 of the first example described above. The thickness of the heat sensitive softening layer 6a is for example 20 μm or below, and preferably in the order of 2 to 15 μm.

Figure 3:
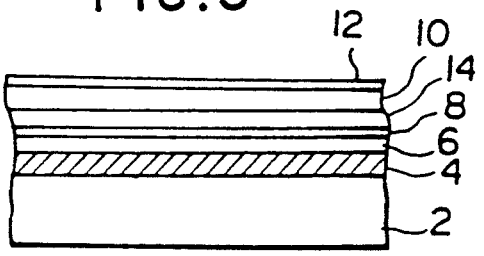

FIG. 3 is a schematic partial cross sectional view showing a third example of the present heat sensitive recording medium, wherein parts identical with those in FIG. 1 are designated by the same reference characters.

In the example shown in FIG. 3, the reference character 14 indicates a heat sensitive softening layer that is the same as the heat sensitive softening layer 6 in the first example. The thickness of the heat sensitive softening layer 14 is for example 10 μm or below, and preferably in the order of 0.5 to 5 μm.

Figure 4:
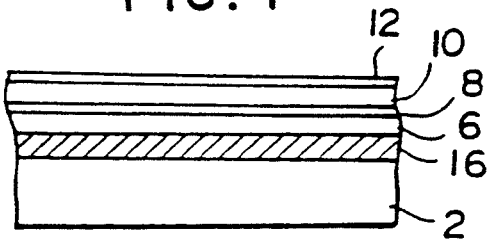

FIG. 4 is a schematic partial cross sectional view showing a fourth example of the present thermal recording medium, wherein parts identical with those in FIG. 1 are designated by the same reference characters.

In the fourth example shown in FIG. 4, the reference character 16 indicates a magnetic recording layer that can also act as a contrasting layer.

As the magnetic recording layer 16, one that is commonly used as a magnetic recording layer in the conventional magnetic recording medium can be used. For example, as the magnetic material, Ba-ferrite, Sr-ferrite, Co-covered $\gamma$-$Fe_2O_3$, $\gamma$-$Fe_2O_3$, needle-like iron powder, or $CrO_2$ which has a particle diameter of 10 μm or below, and preferably 0.01 to 5 μm is used, and as the binder resin, a polyester resin, an alkyd resin, a vinyl resin, a polyurethane resin, or a mixture of these which is commonly used can be used. The mixing ratio of the binder resin to the magnetic material is suitably set by considering the adhesion to the base, the coating film strength, the voltage detected by a magnetic head, and the like. The ratio by weight of the binder resin to the magnetic material can be for example in the range of 1/1 to 1/10, and preferably ½ to ⅛. The thickness of the magnetic recording layer is for example in the order of 10 to 15 μm.

Figure 5:
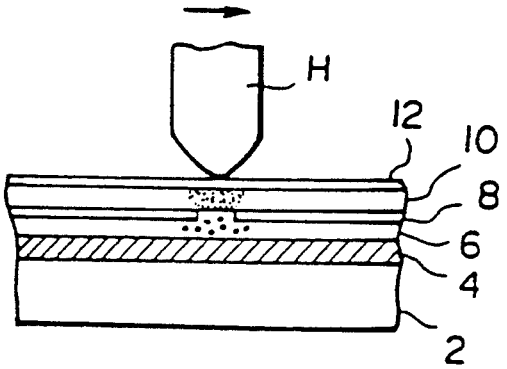
FIG. 5 is a schematic partial cross sectional view for illustrating recording to the present thermal recording medium.

FIG. 5 is a schematic partial cross sectional view of an example of recording to the thermal recording medium according to the present invention, which is that of the example shown in FIG. 1.

As shown in FIG. 5, when a thermal head H is scanned in the direction indicated by an arrow with the thermal head H in contact with the protective layer 10 while the heating element of the head H is heated at suitable timing, by that heating the heat sensitive color forming layer 10 is colored, the heat sensitive softening layer 6 is softened, and the metal thin layer 8 is melted, and since the metal thin layer 8 is thin, when it is melted, it disperses as finely divided particles in the heat sensitive softening layer 6 due to the surface tension. Thus, in the parts where the material of the metal thin layer is dispersed, the metal thin layer 8 is destroyed, and after the passage of the head H, the heat sensitive softening layer 6 solidifies, so that the record is fixed.

In this thermal recording, the parts of the heat sensitive color forming layer 10 that have not been subjected to the heating of the head H are not colored, the metal thin layer 8 remains unchanged at that parts, and that parts take a whitish color that is a mixture of the whitish color of the metal thin layer 8 with the whitish color of the uncolored heat sensitive color forming layer 10 situated thereon. In contrast, in the parts that have been heated by the head H, the heat sensitive color forming layer 10 is colored deep color, and the metal thin layer 8 is destroyed, and as a result the particular parts take a blackish color that is a mixture of the deep color of the colored heat sensitive color forming layer 10 with the blackish color of the contrasting layer 4. Thus, a visual pattern (information) with enough contrast is formed. Additionally, although there are dispersed metal fine particles in the parts of the heat sensitive softening layer 6 that have been heated by the head, the amount of the metal fine particles is too small to hinder the macroscopic observation.

In the thus obtained record, even if the color of the colored heat sensitive color forming layer 10 fades with time, the color of the contrasting layer 4 takes a mixed color to supplement the color fading, thus the contrast of the record lowers hardly in general, and therefore the record changes hardly with time.

Additionally, in the recording to the present thermal recording medium, the heating temperature of the thermal head H may not be high enough to completely destroy prescribed regions (regions corresponding to recording signals) of the metal thin layer 8. This is because; if a little amount of the metal thin layer 8 remains in the prescribed regions, it affects little the contrast of the record since the color of the heat sensitive color forming layer 10 is deep when the recording has been done; even if the color of the heat sensitive color forming layer 10 fades to a certain degree with time, the lowering of the partial recorded contrast becomes not so great since some degree of the color of the heat sensitive color forming layer remains; and therefore the record quality is good enough in comparison with the case wherein recording is carried out on a thermal recording medium of the prior metal thin layer destruction type by using the same relatively low temperature.

In the above example, although the thermal head H is used as a heating means, instead thereof other suitable means that can supply the same amount of heat to destroy the metal thin layer in the same manner can be used.

An example of the production of a thermal recording medium according to the present invention is given below. In this case, the thermal recording medium of the example shown in FIG. 4 was produced.

First, a magnetic sheet was prepared which comprised a white polyethylene terephthalate film 2 having a thickness of 188 μm (E-24 manufactured by Toray Industries, Inc.) and a magnetic recording layer 16 formed thereon, made of Ba-ferrite magnetic material, and having a thickness of 12 μm, a residual magnetization of 1.5 Mx/cm, a coercive force of 2,800 Oe, and a rectangular ratio of 0.85.

Then a heat sensitive softening layer 6 having a thickness of 4 μm was formed on the magnetic recording layer 16. The heat sensitive softening layer 6 was formed by adding, to 100 pts. wt. of a coating obtained by kneading

| | |
|---|---|
| vinyl chloride/vinyl acetate/maleic acid copolymer (VMCH manufactured by Union Carbide Corp.) | 20 pts. wt. |
| benzoguanamine powder (having an average particle diameter of 0.6 μm) | 6 pts. wt. |
| methyl ethyl ketone | 40 pts. wt. |
| toluene | 40 pts. wt. |
| using a ball mill for 4 hours, curing agent (Coronate-L manufactured by Nippon Polyurethane Industry Co., Ltd.) | 0.25 pt. wt. |
| methyl ethyl ketone | 25 pts. wt. |
| toluene | 25 pts. wt. |

followed by stirring, then applying the resulting coating by a bar coater #14, and drying it at 100° C. for 1 minute.

Herein, the benzoguanamine powder was used to roughen the surface of the heat sensitive softening layer 6 to reduce the metallic luster of the metal thin layer to be formed on the heat sensitive softening layer thereby making the metal thin layer whitish, and for this roughening of the surface, other suitable fine particles (e.g., extending pigments) can be used.

Then, on the heat sensitive softening layer 6, an Sn thin layer 8 having a thickness of 1,000 Å was formed by vacuum deposition under a reduced pressure of $10^{-4}$ Torr at a vacuum deposition speed of about 10 Å/sec.

Then, a heat sensitive color forming layer 10 having a thickness of 3 μm was formed on the Sn thin layer 8. In the formation of the heat sensitive color forming layer 10, a coating compound for a color forming agent that consisted of

| | |
|---|---|
| leuco dye (TG-11 manufactured by Nippon Kayaku Co., Ltd.) | 13.5 pts. wt. |
| alkyd resin | 13.5 pts. wt. |
| xylene | 63 pts. wt. |
| and a coating compound for a developer that consisted of acid developer (TG-SA manufactured by Nippon Kayaku Co., Ltd.) | 13.5 pts. wt. |
| alkyd resin | 13.5 pts. wt. |
| xylene | 63 pts. wt. |

were separately ground and dispersed in different ball mills to reduce the color forming agent and the developer to have a particle diameter of about 1 μm, 100 pts. wt. of each of them, and 1.8 pts. wt. of a curing agent (Coronate-EH manufactured by Nippon Polyurethane Industry Co., Ltd.) were mixed in a high-speed stirrer, and the obtained coating was applied by a bar coater #7, and dried at 50° C. for 30 minutes.

Next, a protective layer 12 was formed on the heat sensitive color forming layer 10. In the formation of the protective layer, 1 pt. of a curing agent (Coronate-EH manufactured by Nippon Polyurethane Industry Co., Ltd.) was added to 100 pts. of a coating obtained by stirring

| | |
|---|---|
| alkyd resin | 18 pts. wt. |
| polyethylene wax | 2 pts. wt. |
| xylene | 80 pts. wt. |

by a ball mill for 2 hours to disperse the polyethylene wax, and after they were stirred well in a high-speed stirrer, the obtained coating was applied by a bar coater #4, and was dried at 50° C. for 30 minutes. Here, the polyethylene wax was added to obtain lubricity to withstand the sliding contact with a magnetic head thereby preventing sticking when heated by the thermal head.

Thus, the thermal recording medium that can also function as a magnetic recording medium can be formed into a card to act as a prepaid card, and in this case, the thermal recording can be used effectively in printing the use record (date, fee, etc.) of the card, and details of the remainder. That is, in each use, the amount of remaining money recorded in the magnetic recording layer is revised, and the details are printed on the surface of the card by thermal recording, so that the user can know the contents of the card at all times.

Additionally, in order not to increase the distance between the magnetic head and the magnetic recording layer to make such a function of the magnetic recording medium exhibit favorably, it is preferable that the total thickness from the heat sensitive softening layer 6 to the protective layer 12 is 10 μm or below.

In the above example, a desired design may be printed on the undersurface of the base 2. In addition, a desired design may be printed on the protective layer 12 or the heat sensitive color forming layer 10, and in this case, the design may cooperate with the visual pattern of the above thermal record to exhibit a desired display.

What is claimed is:

1. A thermal recording medium comprising (1) a contrasting layer, a heat sensitive softening layer disposed on said contrasting layer and a thin metal layer disposed on said heat sensitive softening layer, said thin metal layer having a thickness of 100 to 2000 Å, for effecting a first thermal recording, said thin metal layer being composed of low-melting metals or low-melting alloys and said contrasting layer having a visual contrast to said thin metal layer; and (2) a heat sensitive color forming layer disposed on said thin metal layer, for effecting a second thermal recording; said first thermal recording being effected by destroying said thin metal layer in defined pattern to disperse fine particles of the melted metal in softened heat sensitive softening layer; and said first and second thermal recordings being effected simultaneously in the same pattern by means of the same heat source, thereby forming a visual pattern with a contrast between (a) a first color of {the undestroyed thin metal layer+the uncolored heat sensitive color forming layer}, and (b) a second color of {the contrasting layer as viewed through the destroyed area of said thin metal layer+the colored heat sensitive color forming layer}.

2. A thermal recording medium as set forth in claim 1, wherein said contrasting layer is disposed on a base.

3. A thermal recording medium as set forth in claim 1, wherein said contrasting layer additionally comprises a magnetic recording layer, the magnetic recording layer including a magnetic material and a binder resin, the ratio by weight of the binder resin to the magnetic material being in the range of 1/1 to 1/10.

4. A thermal recording medium as set forth in claim 1, wherein a protective layer is disposed on said heat sensitive color forming layer, said protective layer having a thickness of 1 to 5 μm.

5. A thermal recording medium as set forth in claim 1, wherein said heat sensitive color forming layer contains a leuco dye, an acid developer and a binder resin, the ratio of the leuco dye to the acid developer being 1:0.5 to 1:3 by equivalent and the ratio of the binder resin to (the leuco dye+the acid developer) being 1:0.1 to 1:3 by weight.

6. A thermal recording medium comprising (1) a heat sensitive softening layer acting also as a contrasting layer and a thin metal layer disposed on said contrasting layer, said thin metal layer having a thickness of 100 to 2000 Å, for effecting a first thermal recording, said thin metal layer being composed of low-melting metals or low-melting alloys, and said contrasting layer having a visual contrast to said thin metal layer; and (2) a heat sensitive color forming layer disposed on said thin metal layer, for effecting a second thermal recording; wherein said first thermal recording is effected by destroying said thin metal layer in defined pattern to disperse fine particles of the melted metal in the softened heat sensitive softening layer; said first and second thermal recordings being effected simultaneously in the same pattern by means of the same heat source, thereby forming a visual pattern with a contrast between (a) a first color of {the undestroyed thin metal layer+the uncolored heat sensitive color forming layer}, and (b) a second color of {the contrasting layer as viewed through the destroyed area of said thin metal layer+the colored heat sensitive color forming layer}.

7. A thermal recording medium as set forth in claim 6, wherein said contrasting layer is disposed on a base.

8. A thermal recording medium as set forth in claim 6, wherein a protective layer is disposed on said heat sensitive color forming layer, said protective layer having a thickness of 1 to 5 μm.

9. A thermal recording medium as set forth in claim 6, wherein said heat sensitive color forming layer contains a leuco dye, an acid developer and a binder resin, the ratio of the leuco dye to the acid developer being 1:0.5 to 1:3 by equivalent and the ratio of the binder resin to (the leuco dye+the acid developer) being 1:0.1 to 1:3 by weight.

10. A thermal recording medium comprising (1) a contrasting layer, a thin metal layer having a thickness of 100 to 2000 Å disposed on said contrasting layer and a heat sensitive softening layer disposed on said thin metal layer, for effecting a first thermal recording, said thin metal layer being composed of low-melting metals or low-melting alloys, and said contrasting layer having a visual contrast to said thin metal layer; and (2) a heat sensitive color forming layer disposed on said heat sensitive softening layer, for effecting a second thermal recording; wherein said first thermal recording is effected by destroying said thin metal layer in defined pattern to disperse fine particles of the melted metal in softened heat sensitive softening layer, said first and second thermal recordings being effected simultaneously in the same pattern by means of the same heat source, thereby forming a visual pattern with a contrast between (a) a first color of {the undestroyed thin metal layer+the uncolored heat sensitive color forming layer}, and (b) a second color of {the contrasting layer as viewed through the destroyed area of said thin metal layer+the colored heat sensitive color forming layer}.

11. A thermal recording medium as set forth in claim 10, wherein said contrasting layer is disposed on a base.

12. A thermal recording medium as set forth in claim 10, wherein said contrasting layer additionally comprises a magnetic recording layer, the magnetic recording layer including a magnetic material and a binder resin, the ratio by weight of the binder resin to the magnetic material being in the range of 1/1 to 1/10.

13. A thermal recording medium as set forth in claim 10, wherein a protective layer is disposed on said heat sensitive color forming layer, said protective layer having a thickness of 1 to 5 μm.

14. A thermal recording medium as set forth in claim 10, wherein said heat sensitive color forming layer contains a leuco dye, an acid developer and a binder resin, the ratio of the leuco dye to the acid developer being 1:0.5 to 1:3 by equivalent and the ratio of the binder resin to (the leuco dye+the acid developer) being 1:0.1 to 1:3 by weight.

15. A thermal recording medium comprising (1) a contrasting layer, a first heat sensitive softening layer disposed on said contrasting layer, a thin metal layer having a thickness of 100 to 2000 Å disposed on said first heat sensitive softening layer and a second heat sensitive softening layer disposed on said thin metal layer, for effecting a first thermal recording, said thin metal layer being composed of low-melting metals or low-melting alloys and said contrasting layer having a visual contrast to said thin metal layer; and (2) a heat sensitive color forming layer disposed on said second heat sensitive softening layer, for effecting a second thermal recording; wherein said first thermal recording is effected by destroying said thin metal layer in defined pattern to disperse fine particles of the melted metal in the softened heat first and second thermal recordings being effected simultaneously in the same pattern by means of a common heat source, thereby forming a visual pattern with a contrast between (a) a first color of {the undestroyed thin metal layer+the uncolored heat sensitive color forming layer}, and (b) a second color of {the contrasting layer as viewed through the destroyed area of said thin metal layer+the colored heat sensitive color forming layer}.

16. A thermal recording medium as set forth in claim 15, wherein said contrasting layer is disposed on a base.

17. A thermal recording medium as set forth in claim 15, wherein said contrasting layer additionally comprises a magnetic recording layer, the magnetic recording layer including a magnetic material and a binder resin, the ratio by weight of the binder resin to the magnetic material being in the range of 1/1 to 1/10.

18. A thermal recording medium as set forth in claim 15, wherein a protective layer is disposed on said heat sensitive color forming layer, said protective layer having a thickness of 1 to 5 μm.

19. A thermal recording medium as set forth in claim 15, wherein said heat sensitive color forming layer contains a leuco dye, an acid developer and a binder resin, the ratio of the leuco dye to the acid developer being 1:0.5 to 1:3 by equivalent and the ratio of the binder resin to (the leuco dye+the acid developer) being 1:0.1 to 1:3 by weight.

20. A thermal recording medium comprising (1) a first heat sensitive softening layer acting also as a contrasting layer, a thin metal layer having a thickness of 100 to 2000 Å disposed on said contrasting layer and a second heat sensitive softening layer disposed on said thin metal layer, for effecting a first thermal recording, said thin metal layer being composed of low-melting metals or low-melting alloys, and said contrasting layer having a visual contrast to said thin metal layer; and (2) a heat sensitive color forming layer disposed on said second heat sensitive softening layer, for effecting a second thermal recording; wherein said first thermal recording is effected by destroying said thin metal layer in defined pattern to disperse fine particles of the melted metal in softened first and second heat sensitive softening layers, and wherein said first and second thermal recordings are effected simultaneously in the same pattern by means of a common heat source, thereby forming a visual pattern with a contrast between (a) a first color of {the undestroyed thin metal layer+the uncolored heat sensitive color forming layer}, and (b) a second color of {the contrasting layer as viewed through the destroyed area of said thin metal layer+the colored heat sensitive color forming layer}.

21. A thermal recording medium as set forth in claim 20, wherein said contrasting layer is disposed on a base.

22. A thermal recording medium as set forth in claim 20, wherein a protective layer is disposed on said heat sensitive color forming layer, said protective layer having a thickness of 1 to 5 μm.

23. A thermal recording medium as set forth in claim 20, wherein said heat sensitive color forming layer contains a leuco dye, an acid developer and a binder resin, the ratio of the leuco dye to the acid developer being 1:0.5 to 1:3 by equivalent and the ratio of the binder resin to (the leuco dye+the acid developer) being 1:0.1 to 1:3 by weight.

* * * * *

UNITED STATES PATENT AND TRADEMARK OFFICE

CERTIFICATE OF CORRECTION

PATENT NO. : 5,294,587

DATED : March 15, 1994

INVENTOR(S) : Shigeru Nakagami, et al.

It is certified that error appears in the above-identified patent and that said Letters Patent is hereby corrected as shown below:

Column 9, line 64, after "softened", insert --first and second--.

Column 9, line 64, after "heat", insert --sensitive softening layers; said--.

Signed and Sealed this

Fifth Day of July, 1994

*Attest:*

*Attesting Officer*

BRUCE LEHMAN

*Commissioner of Patents and Trademarks*